United States Patent [19]

Kent

[11] Patent Number: 4,489,942

[45] Date of Patent: Dec. 25, 1984

[54] TENNIS RACKET AND STRING ALIGNER THEREFOR

[76] Inventor: Willie D. Kent, 280 S. Euclid, #319, Pasadena, Calif. 91101

[21] Appl. No.: 427,469

[22] Filed: Sep. 29, 1982

[51] Int. Cl.[3] ..... A63B 49/00

[52] U.S. Cl. ..... 273/73 R; 273/74

[58] Field of Search ..... 273/73 R, 73 B, 74, 273/73 D, 73 A; D7/101

[56] References Cited

U.S. PATENT DOCUMENTS

| | | | |
|---|---|---|---|
| D. 159,908 | 8/1950 | Hulqvist | D7/101 |
| 2,396,020 | 3/1946 | Savage | D7/101 X |
| 4,089,523 | 5/1978 | Newburger et al. | 273/73 R |

FOREIGN PATENT DOCUMENTS

| | | | |
|---|---|---|---|
| 0019065 | 11/1980 | European Pat. Off. | 273/74 |
| 470930 | 8/1937 | United Kingdom | 273/74 |
| 506000 | 5/1939 | United Kingdom | 273/74 |
| 505658 | 5/1939 | United Kingdom | 273/74 |

*Primary Examiner*—Richard C. Pinkham
*Assistant Examiner*—Matthew L. Schneider
*Attorney, Agent, or Firm*—Donald D. Mon; David O'Reilly

[57] ABSTRACT

A device for aligning strings in a grid of tennis racket comprised of a base having a peripheral groove for receiving the frame of the racket. The base has a plurality of posts arranged and shaped to intersect the spaces between strings. A cover is hinged to the base and acts as a press to force the tennis racket down on the posts, causing strings to become aligned.

6 Claims, 2 Drawing Figures

TENNIS RACKET AND STRING ALIGNER THEREFOR

FIELD OF THE INVENTION

This invention relates to devices for aligning strings on a grid and more particularly relates to aligning tennis racket strings inside their frame.

BACKGROUND OF THE INVENTION

Stringed rackets used for games such as tennis and racquet-ball are comprised of strings interwoven in a somewhat ovular frame. even though the strings are tightly interwoven, still they often become misaligned relative to one another during use. Misalignment of the strings is undesirable because it can cause an uneven or unpredictable force on a ball, resulting in a miss-hit. In fact, it is not uncommon to see a player realigning the strings with his fingers during a match. Of course, the strings can be pulled into alignment by the fingers but this is a time-consuming as well as an inaccurate method of doing so. It would be advantageous if the strings could all be aligned quickly in one simple operation.

It is an object of the invention to provide a device for aligning strings in a frame to provide a device for aligning such strings.

Still another object of the invention is to provide a press comprised of a base having a plurality of posts on a cover into which a stringed racket can be pressed to align the strings.

BRIEF DESCRIPTION OF THE INVENTION

The string aligning device is comprised of a base having a peripheral channel shaped to receive the frame of a stringed racket. A plurality of tapered posts are arranged in a pattern on the base to intersect the spaces between the strings. A cover hinged to the base is pressed down on the base forcing the racket down on the tapered posts, simultaneously aligning all the strings. The tapered posts are arranged and disposed to intersect the portion of the string area slightly larger than the area in the center of the racket frequently referred to as the "sweet spot." The sweet spot is a central area where the racket exerts the most accurate control and best transmission of force. It is also the region where the strings tend most to become misaligned.

In the areas closer to the frame, the strings are tightest. There they are least likely to become misaligned, but the spaces between the strings are irregular in shape. In the area toward the center of the strings (including the sweet spot) the spaces are nearly square when the strings are properly aligned. Therefore, aligning the strings at the center can readily be done with simple tapered posts, and need be done only mainly near the center of the pattern.

The above and other features of the invention will be fully understood from the following detailed description and the accompanying drawings, in which:

DETAILED DESCRIPTION OF THE INVENTION

Figure 1:
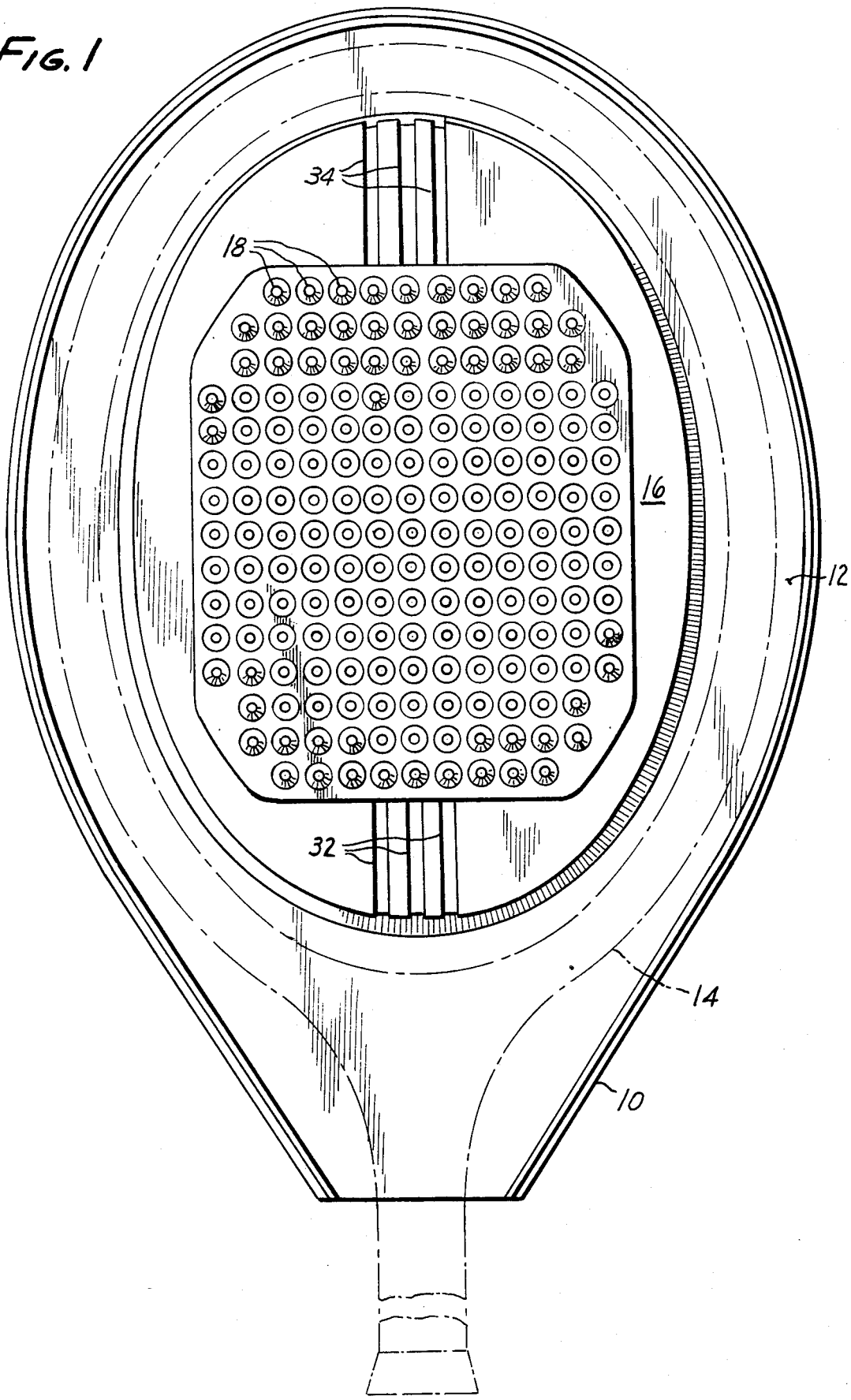
FIG. 1 is a plan view of the base of a string aligning device according to the invention.

A string aligning device is shown in FIG. 1 and is comprised of a base 10 having a peripheral channel 12 for receiving the frame of a stringed racket 14 shown in phantom without strings. Of course, the shape of the base channel would be designed for accommodating the type or size of stringed racket it is to be used for.

The base 10 is provided with a platform or central raised portion 16 (FIG. 2) on which is formed an array of tapered posts 18 arranged in a pattern. Toward the center, the posts will be in the form of truncated cones, but other shapes would instead be suitable. As can be seen in FIG. 1, the array of posts is arranged to intersect the spaces between the strings of a racket except near the racket head or frame. In these latter areas the spaces between the strings are generally irregular in shape, and the strings are also tightest and so much less likely to become misaligned.

The number of posts in the pattern is selected to cover an area of the strings substantially larger than the area in the center frequently referred to as the "sweet spot." Again the number of tapered posts 18 in the pattern will depend on the size and shape of the racket the aligning device is designed for.

Figure 2:
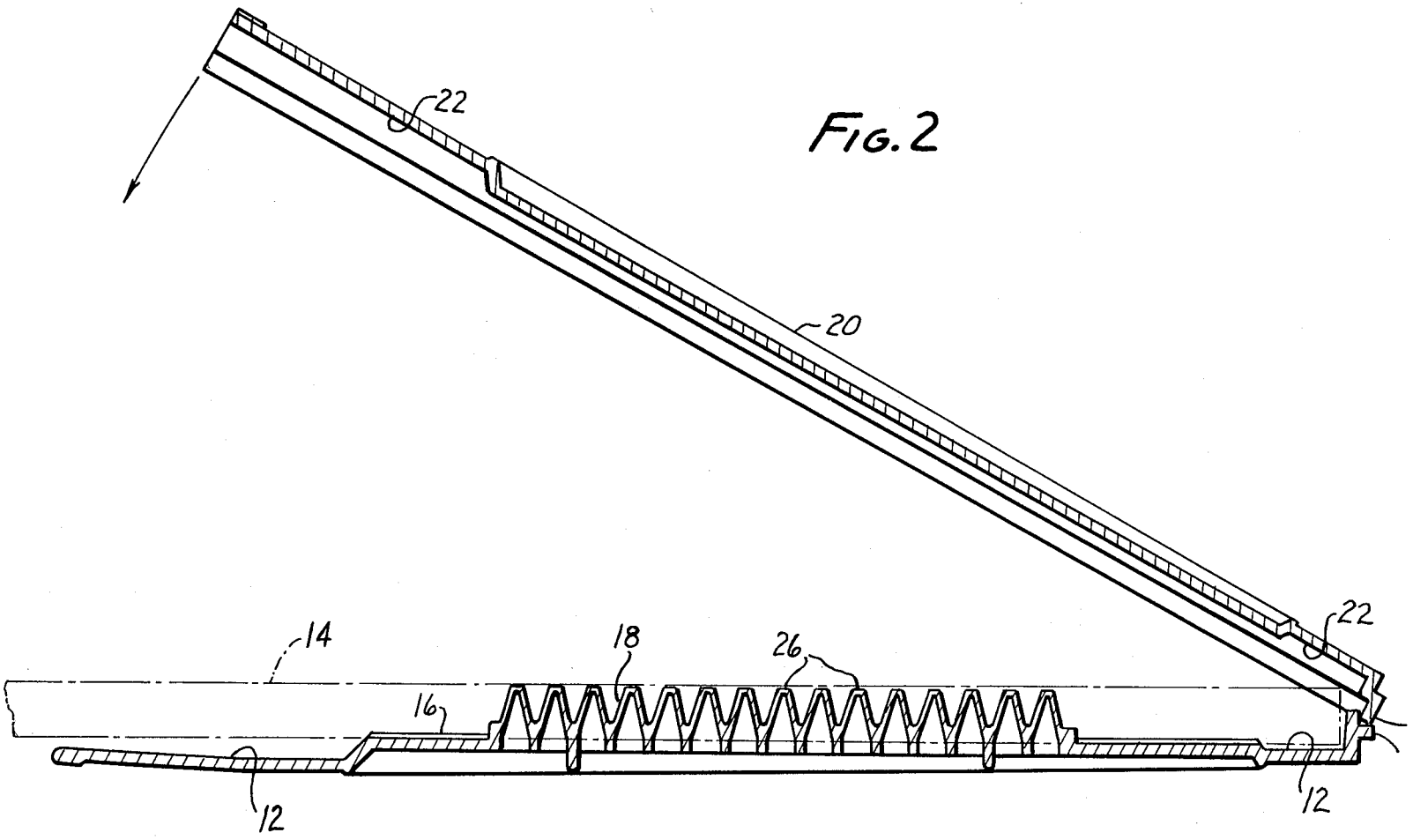
FIG. 2 is a sectional side elevation of the base with a mating cover.

A cover 20 for pressing the stringed racket 14 down onto the tapered posts 18 is shown in FIG. 2. Cover 20 also has a peripheral channel 22 and a matching platform 24, except that platform 24 is flat and mates with the flat tops 26 of tapered posts 18. Cover 22 has a flange 28 which mates with flange 30 on the base to form a pinless hinge.

In use, the base can be mounted on a wall or laid on any flat even surface such as a table. A stringed racket is placed on the base with the frame in groove 12 and the posts intersecting the spaces between the strings. Visual guides for centering the frame on the base are provided by grooves 32,34 below and above the tapered post array. The cover is then placed over the base and pressed down on the racket frame, forcing the tapered posts into the spaces between the strings. In this manner the strings of the racket are quickly and easily aligned in one operation.

The cover is a useful feature of the invention, and enables the racket to be carried with its strings well aligned. However, the base with it posts is useful by itself and might, for example, be wall-mounted, rather than being adapted for carrying around as part of a case.

This invention is not to be limited by the embodiments shown in the drawings and described in the description, which are given by way of example and not of limitation, but only in accordance with the scope of the appended claims.

I claim:

1. In combination: a racquet for playing a racquet game, which racquet includes a frame that supports strings as a grid with apertures formed between intersecting strings so as to form an array; and a device for aligning said strings in said frame, said device comprising a base, a plurality of posts rising from said base, and arranged in a pattern to conform to at least a part of said array, each said post being so shaped and so disposed and arranged as to contact at least two strings which bound the aperture into which it enters, and a cover adapted to fit against said base and sandwich said frame between them, said posts thereby aligning the strings contacted by them, and said base and cover enclosing said frame, but enabling removal of the frame from between them.

2. A device according to claim 1 in which said cover is hingedly mounted to said base.

3. A device according to claim 2 in which said posts are circularly sectioned, whereby to align the strings they abut without contacting the strings at their intersections.

4. A device according to claim 3 in which said posts are conically tapered, reducing in cross-section as they extend away from said base.

5. A device according to claim 1 in which said base and said cover form a carrying case for a stringed racket that includes said frame and said strings.

6. A device according to claim 1 in which said posts are tapered, reducing in cross-section as they extend away from said base.

* * * * *